US006396455B1

(12) United States Patent
Ely et al.

(10) Patent No.: US 6,396,455 B1
(45) Date of Patent: May 28, 2002

(54) ANTENNA WITH REDUCED MAGNETIC FAR FIELD FOR EAS MARKER ACTIVATION AND DEACTIVATION

(75) Inventors: Reuel Andrew Ely, Plantation; Ronald B. Easter, Parkland, both of FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/712,492

(22) Filed: Nov. 14, 2000

(51) Int. Cl.[7] ..... H01Q 7/08
(52) U.S. Cl. ..... 343/788
(58) Field of Search ..... 343/787, 788, 343/741, 742, 866, 867, 895; 340/572

(56) References Cited

U.S. PATENT DOCUMENTS 2,354,332 A * 7/1944 Polydoroff ..... 343/788
4,725,845 A * 2/1988 Phillips ..... 343/702
5,051,726 A 9/1991 Copeland et al. ..... 340/572
5,218,371 A 6/1993 Copeland et al. ..... 343/742
5,495,259 A * 2/1996 Lyasko ..... 343/788

* cited by examiner

*Primary Examiner*—Don Wong
*Assistant Examiner*—Hoang Nguyen
(74) *Attorney, Agent, or Firm*—Rick F. Comoglio; Paul T. Kashimba

(57) ABSTRACT

An EAS activation/deactivation antenna in accordance with the invention comprises a core; a coil arrangement having at least two coils spirally wrapped about the core, the first coil having a first rotational direction and the second coil having a rotational direction counter to the first rotational direction; and, a current source operatively connected to the coil arrangement. In consequence of the inventive arrangement, a decaying or steady state, alternating or direct current supplied by a current source can excite the coil arrangement to produce a significant near magnetic field and a reduced far magnetic field, for activation or deactivation of EAS markers.

10 Claims, 6 Drawing Sheets

ANTENNA WITH REDUCED MAGNETIC FAR FIELD FOR EAS MARKER ACTIVATION AND DEACTIVATION

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates to the field of electronic article surveillance (EAS), and more particularly to an antenna adapted for activation and deactivation of EAS markers.

2. Description of the Related Art

Electronic article surveillance (EAS) systems for detecting the unauthorized removal of articles or goods from retail establishments or other facilities are well known and widely used. In general, EAS systems employ a marker secured to an article or item. The marker contains an active element and a bias element. When the bias element is magnetized, or activated, it applies a bias magnetic field to the active element, which causes the active element to be mechanically resonant at a predetermined frequency upon exposure to an interrogation signal, which alternates at the predetermined frequency. The interrogation signal can be generated by detecting apparatus, which can also detect the resonance of the marker, the resonance having been induced by the interrogation signal. Specifically, a transmitter can emit a signal at a defined frequency to the receiver, the area between the transmitter and receiver defining a surveillance area. When the marker encroaches upon the surveillance area, the active element in the marker distorts the transmitted signal, alerting the receiver of the presence of the marker. In response, the receiver can activate an alarm.

The marker can be deactivated or removed by authorized personnel from any article or good authorized to be removed from the premises, thereby permitting passage of the article or good through the surveillance area without triggering an alarm activation. When the marker is deactivated by demagnetizing its active element, the marker can no longer produce the detectable tag signal. Such deactivation of the marker, can occur, for example, when an employee of a retail establishment passes an EAS tagged article over a deactivation device at a checkout counter thereby deactivating the marker. The EAS marker can be deactivated by exposing the bias element to an alternating magnetic field of sufficient magnitude to degauss the bias element. After the bias element is degaussed, the marker's resonant frequency is substantially shifted from the predetermined frequency, and the marker's response to the interrogation signal is at too low an amplitude for detection by the detecting apparatus. Generally, marker activation and deactivation devices include a coil structure energizable to generate a magnetic field of character and magnitude sufficient to render the marker either active or inactive. One known type of marker activation and deactivation device includes one or more coils energized by a current signal to generate the necessary magnetic field.

Activation and deactivation of a marker requires the use of a steady state or time varying magnetic field of a specific intensity. Current antennas used to generate the required magnetic field can generate far magnetic fields capable of interfering with proximate electronic equipment. Thus, items present in retail stores could be adversely affected by exposure to the magnetic field generated by a marker deactivation device. Presently, significant time and expense are required to ameliorate the effects of marker activation and deactivation on proximate electronic equipment. For instance, current amelioration techniques include increasing the physical space between the activation and deactivation antenna and other electronic equipment, shielding the antenna, the affected electronic equipment, or both, and redesigning the affected electronic equipment. Yet, current measures to reduce the interference can add cost to the retail checkout environment. Moreover, the same current measures can degrade the ergonomics of the retail check stand. Consequently, no present solution exists for limiting the far field transmission of a signal while enhancing the strength of a near field signal. Hence, a present need exists for an EAS marker activation/deactivation antenna providing an adequate magnetic field to activate and deactivate an EAS marker in the near field while simultaneously reducing the far field produced to limit interference.

SUMMARY OF THE INVENTION

An EAS marker antenna in accordance with the inventive arrangement provides an adequate magnetic field to activate/deactivate an EAS marker in the near field while simultaneously reducing the far field produced to limit interference. In particular, the present invention includes an arrangement of antenna coils and cores capable of providing an adequate magnetic field to activate or deactivate acoustomagnetic and electromagnetic markers in the near field while simultaneously reducing the far magnetic field. Thus, in limiting electromagnetic interference caused by an EAS marker activation/deactivation antenna, the inventive arrangement has advantages over all current amelioration techniques, and provides an inventive apparatus and method for ameliorating far field interference caused by the activation and deactivation of an EAS marker.

An EAS activation/deactivation antenna in accordance with the inventive arrangements comprises a core; a coil arrangement having at least two coils spirally wrapped about the core, the first coil having a first rotational direction and the second coil having a rotational direction counter to the first rotational direction; and, a current source operatively connected to the coil arrangement. In consequence of the inventive arrangement, a current supplied by the current source can excite the coil arrangement to produce a significant near magnetic field and a reduced far magnetic field.

In one embodiment, the core can be a rectangular core. Furthermore, the core can be formed of powdered iron, or other suitable material. Also, the coil arrangement can comprise a single wire forming two coils spirally wrapped about the core, the first coil having a first rotational direction and the second coil having a rotational direction counter to the first rotational direction. Alternatively, the coil arrangement can comprise a first wire forming two coils spirally wrapped about an y-axis of the core, the first coil having a first rotational direction and the second coil having a rotational direction counter to the first rotational direction; and, a second wire forming two coils spirally wrapped about an x-axis of the core, the first coil having a first rotational direction and the second coil having a rotational direction counter to the first rotational direction.

A method for simultaneously limiting a far magnetic field and enhancing a near magnetic field in an EAS marker activation/deactivation antenna comprises the steps of: first spirally wrapping a first coil about an axis of a core in a first rotational direction; second spirally wrapping a second coil about the axis of the core in a rotational direction counter to the first rotational direction; combining the first and second coils to form a coil arrangement; and, supplying a current to the coil arrangement, wherein the current can excite the coil arrangement to produce a significant near magnetic field and a reduced far magnetic field. In addition, the inventive method can comprise the steps of: third spirally wrapping a third coil about a second axis of the core in a third rotational direction; fourth spirally wrapping a fourth coil about the second axis of the core in a rotational direction counter to the third rotational direction; and, adding the third and fourth coil to the coil arrangement. Finally, the method can include placing an EAS marker in the near magnetic field of the EAS marker activation/deactivation antenna during the supplying step, wherein the supplying step can activate or deactivate the EAS marker while producing a reduced far magnetic field.

Alternatively, a method for simultaneously limiting a far magnetic field and enhancing a near magnetic field in an EAS marker activation/deactivation antenna comprises the steps of: spirally wrapping a wire about an axis of a core in a first rotational direction; reversing the first rotational direction and spirally wrapping the wire about the axis of the core in a rotational direction counter to the first rotational direction; and, supplying a current to the wire, wherein the current can excite the wire to produce a significant near magnetic field and a reduced far magnetic field. In addition, the inventive method can comprise the steps of: spirally wrapping a second wire about a second axis of the core in a second rotational direction; reversing the second rotational direction and spirally wrapping the second wire about the second axis of the core in a rotational direction counter to the second rotational direction; and, supplying the current to the second wire.

The above-described embodiments can be driven by a decaying, alternating (AC) current to produce a decaying, alternating (AC) magnetic field for deactivation of EAS markers. Deactivation can also be accomplished by supplying a steady-state alternating current to produce a steady-state alternating magnetic field, with the required decay resulting from movement of the EAS marker from the field. The above-described embodiments can be driven by a direct current (DC) pulse to produce a direct current (DC) magnetic field pulse for activation of EAS markers. Activation can also be accomplished by supplying a steady state DC current to produce a DC steady state magnetic field.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE INVENTION

A multiple coil antenna can be arranged to have a significant near field while at the same time having a reduced far field. A multiple coil antenna having a significant close range field simultaneous with a reduced far range field can be accomplished by arranging the coil geometry of the antenna to produce a constructive field at close range and a destructive field at far ranges. Specifically, an arrangement of multiple coils can be driven with a waveform to produce a significant near magnetic field with a reduced magnetic far field.

Figure 1:
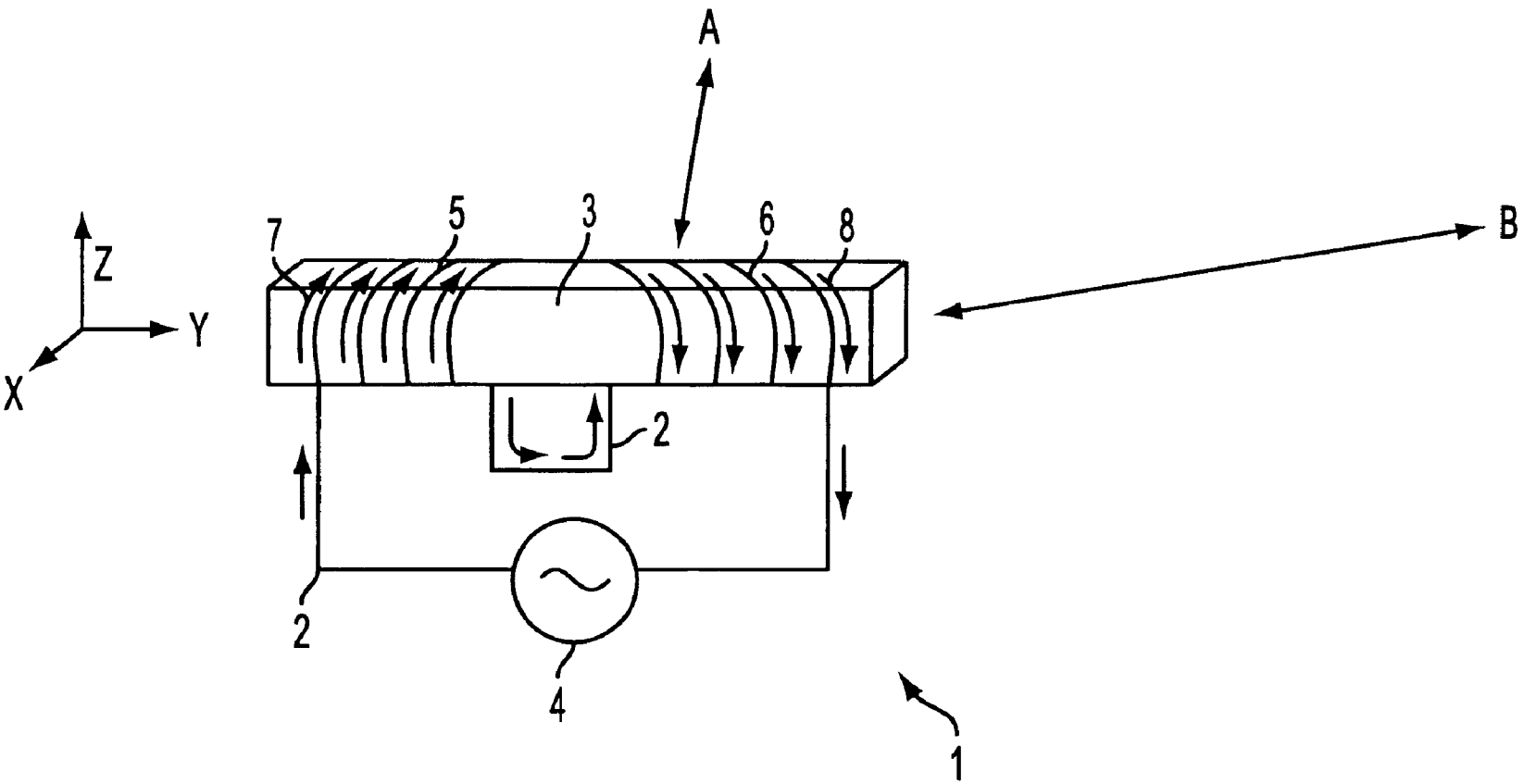
FIG. 1 is a perspective view of an EAS antenna according to the inventive arrangement.

Referring to FIG. 1, antenna 1 includes two coils 5, 6 are arranged on a core 3. In particular, a single wire 2 can be wrapped about the core 3 along the core's y-axis forming a clock-wise spiral pattern 7. After a number of rotations about the core 3, the direction of rotation of the single wire 2 is reversed. The wire 2 can be wrapped about the core 3 along the core's y-axis an additional number of rotations forming a counter-clockwise spiral pattern 8. During the counter-clockwise rotations, however, the wire 2 should not overlap the wire 2 of the previous clockwise rotations. Rather, as shown in the drawing, the additional counter-clockwise rotations should continue along the y-axis in the same direction as the previous clockwise rotations. The American wire gauge (AWG) of wire 2 and the number of clockwise and counter-clockwise rotations are selected according to the specific performance requirements of the magnetic field desired. For example, not to be limiting, the gauge of wire 2 may be in the range of about 10 to 18 AWG wire, and the number of windings may be in the range of about 30 to 80 wraps. Other size wires and number of windings are possible depending on the desired performance requirements of the generated magnetic field.

Figure 2:
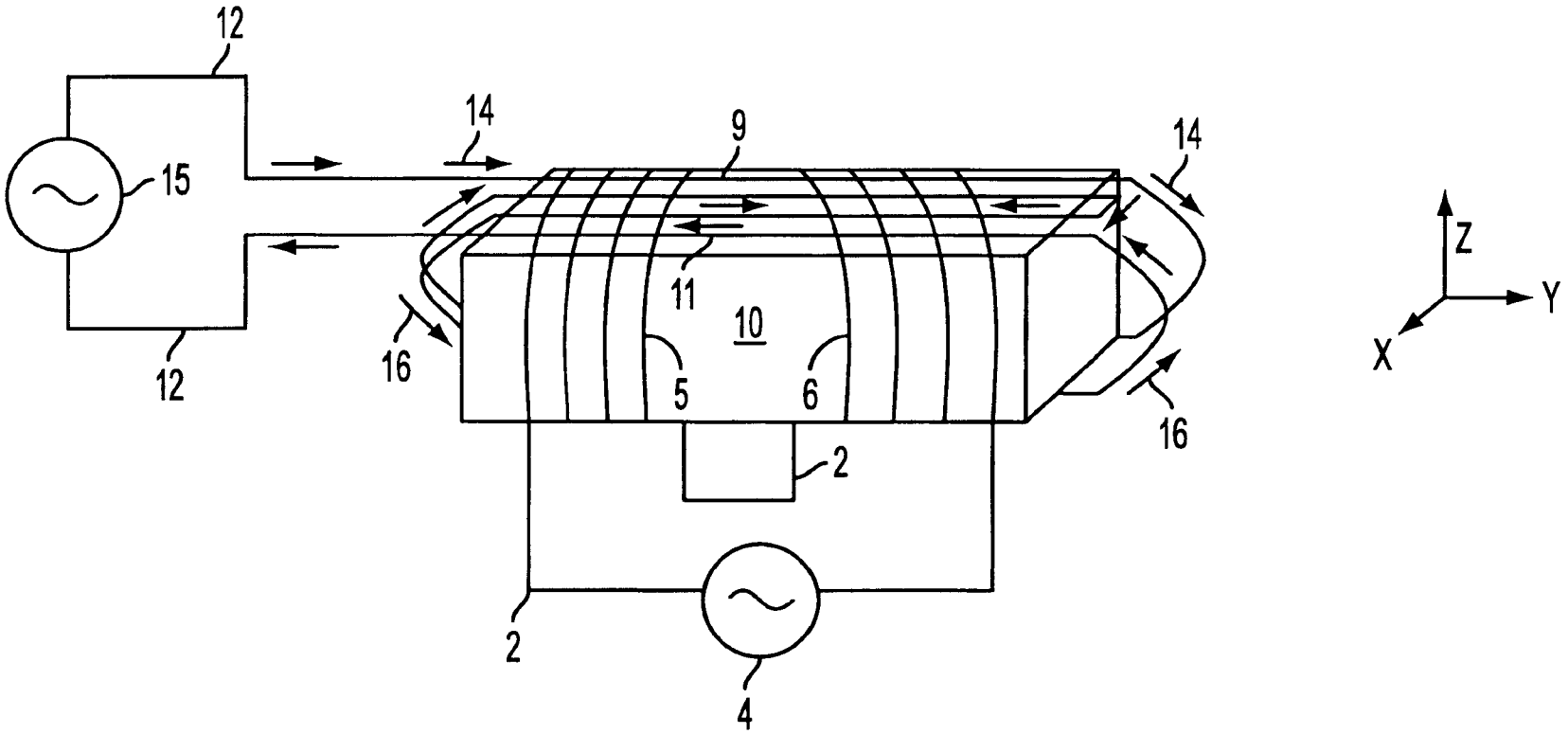
FIG. 2 is a perspective view of an alternate embodiment of an EAS antenna according to the inventive arrangement.

Referring to FIG. 2, in an alternate embodiment, two additional coils 9, 11 can be arranged on the rectangular core 10. In particular, a second wire 12 can be wrapped about the core 10 along the core's x-axis forming a clock-wise spiral pattern 14. After a number of rotations about the core 10, the direction of rotation of the single wire is reversed. The wire can be wrapped about the core 10 along the core's x-axis an additional number of rotations forming a counter-clockwise spiral pattern 16. Additional coils can be added in like manner to form additional embodiments of the invention (not shown).

In the above embodiments, the cores 3, 10 can be formed of powdered iron or another suitable material, and can have a rectangular shape. Cores 3 and 10 differ slightly in shape to facilitate the addition of coils 9 and 11 on core 10. Still, the invention is not limited in this regard. Rather, the cores 3, 10 can have a cylindrical shape, spherical shape, or any other shape upon which the coil 5, 6 and coils 5, 6, 9, 11 can be applied. A rectangular shape is chosen merely for the convenience of wrapping the coils 5, 6, about the x-axis, or wrapping the coils 5, 6, 9, 11 about the x-axis and y-axis, respectively. As in selection of the wire and number of wire windings about the core, the dimensions of the core is selected according to the performance requirements of the generated magnetic field. Example dimensions, for a core 3, 10 made of powdered iron material, include, but are not limited to, 12"×5"×1"; or 6"×6"×1". One example for an antenna made in accordance with the present invention as shown in FIG. 2, uses a powdered iron core of about 12"×5"×1", with a total of 46 turns of 12 AWG wire on the x-axis, and a total of 72 turns of 12 AWG wire on the y-axis.

The coils 5, 6 can be excited with a current generated by a current source 4 operatively connected to the coils 5, 6, as shown in FIG. 1. Likewise, coils 9, 11 can be excited with a current generated by a current source 15 operatively connected to the coils 9, 11, as shown in FIG. 2. Current source 4 and 15 are driven in sequential timeframes. In both embodiments described, the drive current for deactivation can be a burst of alternating current at about a 500 Hz frequency. Each burst can be repeated every 90 Hz. A 4,000 Amp-Turn current can be applied to the coils 5, 6, 9, and 11. Still, the applied current level varies with the desired strength of the near field signal. Hence, the invention is not limited with respect to the applied current. Rather, any suitable drive current will suffice, depending on the application for the antenna. An AC steady state or decaying current is used for generation of a deactivation magnetic field, and a DC steady state or pulse is used for generating an activation magnetic field.

Referring again to FIG. 1, the near magnetic field measured at point A is significant. In contrast, the far magnetic field measured at point B is substantially lower than that generated by a single coil having an equivalent amp-turn excitation. Point A and point B represent near field and far field measurement points, as known in the art. Basically, point A is within about the same distance away from antenna 1 as the longest dimension of the core (measured along the y-axis for core 3), and point B is in the order of 2–3 times farther away than A. Thus, the arrangement of both coils 5, 6 can be driven by current source 4 to produce a significant near magnetic field with a reduced magnetic far field, as fully explained below.

Figure 3:
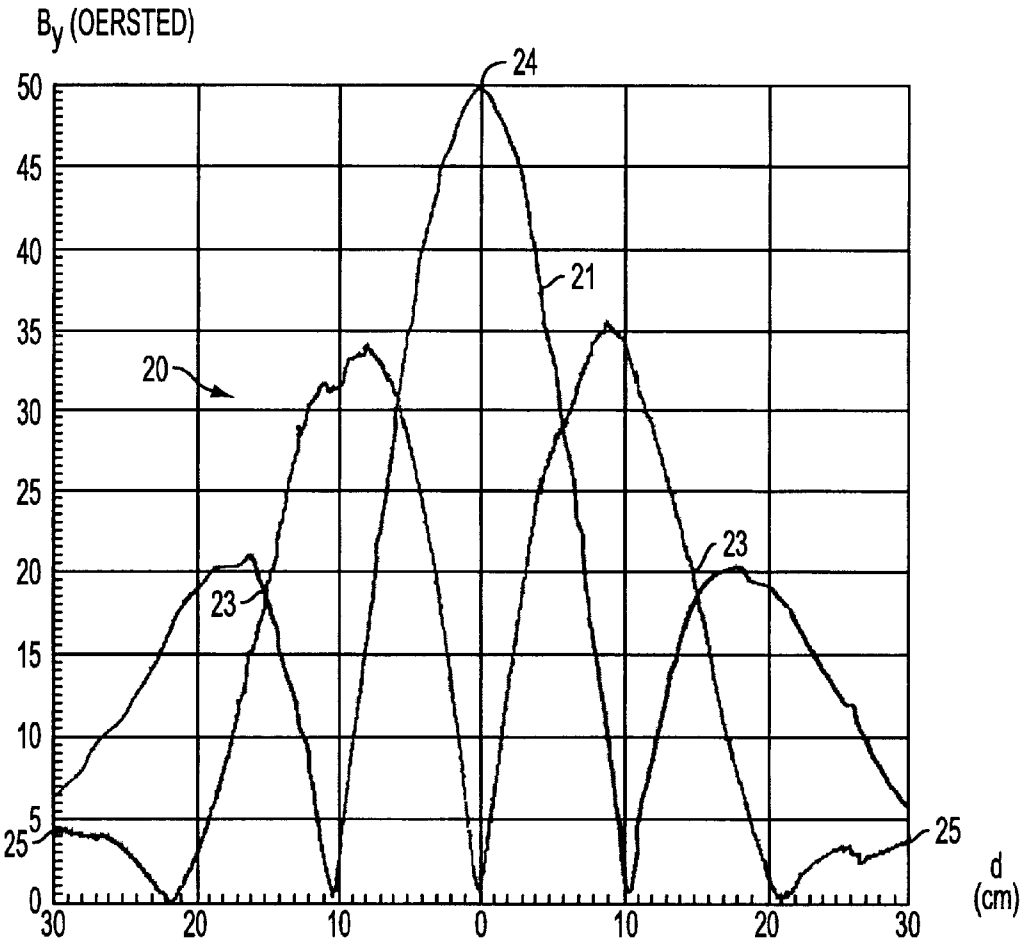
FIG. 3 is a graph illustrating magnetic field strength emitted from an EAS antenna according to the inventive arrangement.

Referring to FIG. 3, in operation, a multiple coil antenna 1 built in accordance with the present invention can result in a significant near magnetic field A and corresponding reduced far magnetic field B, as shown in FIG. 1. Specifically, FIG. 3 illustrates magnetic field strength emitted from a multiple coil antenna 1, built according to the embodiment shown in FIG. 1, when excited by a 4,000 Amp-Turn current source 4. In FIG. 3, two magnetic field measurements are made, one in the y-direction and one in the z-direction away from the multiple coil antenna 1. Trace 20 shows the magnetic field strength measured in the y-direction, and Trace 21 shows the magnetic field strength measured in the z-direction. The near field 23 is defined as the area within 15 cm. from the center 24 of the multiple coil antenna. Correspondingly, the far field 25 is defined as the area extending beyond 30 cm. from the center 24 of the multiple coil antenna. As is evident from the graph in FIG. 3, the strength of the magnetic field measured in the near field 23 ranges from approximately 19 oersted at 15 cm. from the center 24 of the multiple coil antenna as measured in Trace 20, to 50 oersted directly above the antenna as measured in Trace 21. Significantly, however, the strength of the magnetic field measured in the far field 25 is approximately 5 oersted at 30 cm. from the center 24 of the multiple coil antenna as measured in Trace 20.

Figure 4:
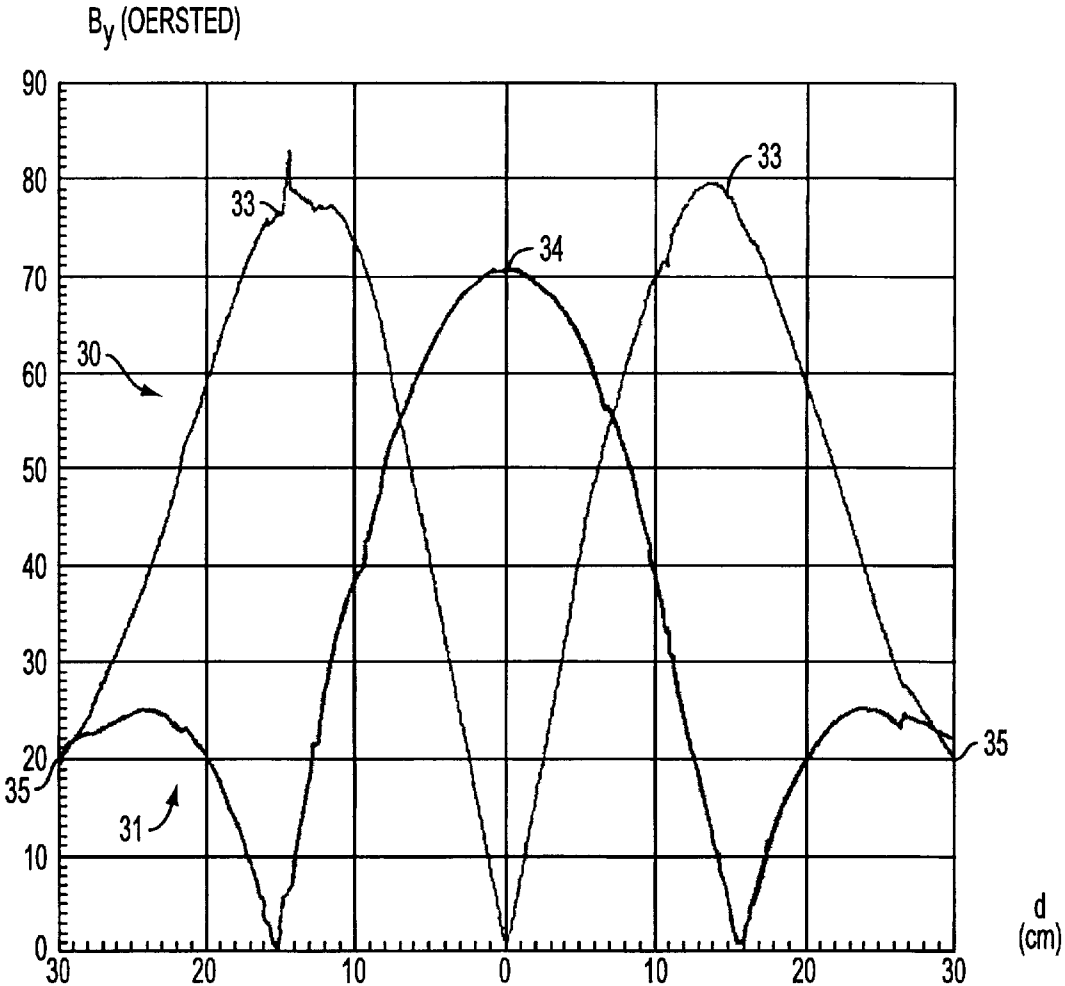
FIG. 4 is a graph illustrating magnetic field strength emitted from a conventional EAS antenna.

In contrast, FIG. 4 shows the magnetic field strength emitted from a conventional EAS activation/deactivation antenna having a coil wound unidirectionally on a core. As is evident from the graph in FIG. 4, the strength of the magnetic field measured in the near field 33 ranges from approximately 76 oersted at 15 cm. from the center 34 of the conventional antenna as measured in Trace 30, to 71 oersted directly above the antenna as measured in Trace 31. However, the strength of the magnetic field measured in the far field 35 is approximately 20 oersted at 30 cm. from the center 34 of the conventional antenna as measured in both Trace 30 and Trace 31. Hence, the magnetic field measured in FIG. 3 represents a four-fold reduction in the strength of the magnetic field in the far field 25 (35 in FIG. 4). Conversely, the strength of the magnetic field as measured in the near field 23 (33 in FIG. 4), while reduced, remains at a level sufficient to activate and deactivate EAS markers. Thus, the current supplied by the current source can excite the coils to produce a significant near magnetic field and a reduced far magnetic field.

Figure 5:
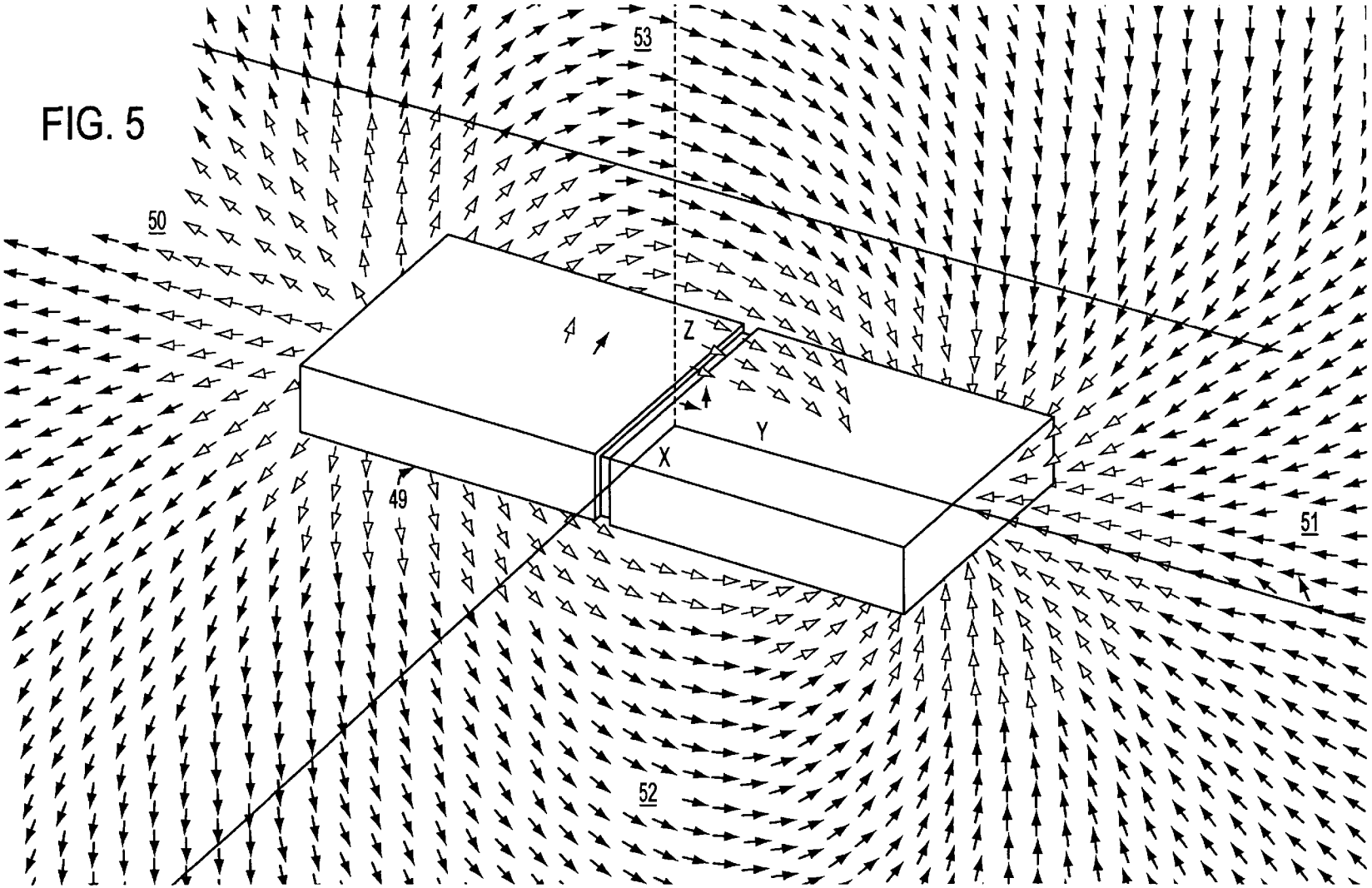
FIG. 5 is an illustration of the magnetic flux generated by a conventionally wound EAS antenna.

Referring to FIG. 5, a magnetic field flux pattern for a conventionally wound antenna 49 having unidirectional coil windings is illustrated. The arrows 50 and 51, representing magnetic flux from antenna 49, point generally in the same direction as each other, and toward the left side of the illustration. The arrows 52 and 53 representing magnetic flux likewise point generally in the same direction as each other, and toward the right side of the illustration. If one were to move farther away from the illustration, it is apparent that the arrows representing magnetic flux, 50, 51 and 52, 53 will add together forming a net summed magnetic far field when measured in the y-axis and z-axis, respectively, due to antenna 49.

Figure 6:
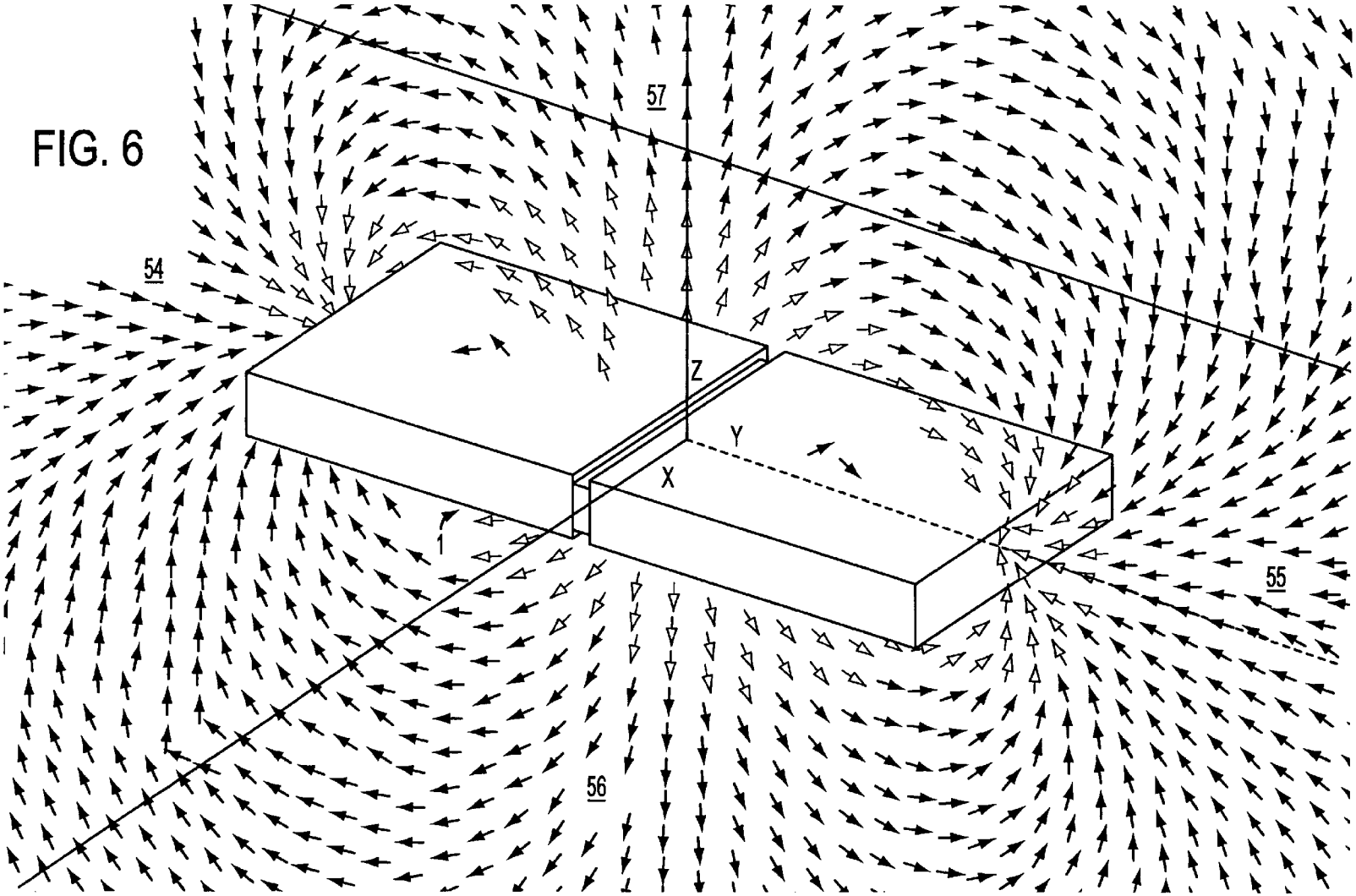
FIG. 6 is an illustration of the magnetic flux generated by an EAS antenna made in accordance with the present invention.

Referring to FIG. 6, a magnetic field flux pattern for an antenna 1 made in accordance with the present invention is illustrated. The arrows 54 and 55, representing magnetic flux from antenna 1, point generally in opposite directions from each other, and toward the ride and left side, respectively, of the illustration. The arrows 56 and 57 representing magnetic flux likewise point generally in the same direction as each other, and toward the bottom and top, respectively, of the illustration. If one were to move farther away from the illustration, it is apparent that the arrows representing magnetic flux will subtract from each other and will not form a net summed magnetic far field when measured in the y-axis and z-axis, respectively, due to antenna 1. FIGS. 5 and 6 graphically illustrate how the magnetic far field is reduced when using an antenna made in accordance with the present invention.

It is to be understood that the phraseology or terminology employed herein is for the purpose of description, and not of limitation. Accordingly, the invention is intended to embrace all such alternatives, modifications, equivalents, and variations as fall within the spirit and broad scope of the appended claims.

What is claimed is:

1. An electronic article surveillance (EAS) antenna for activating or deactivating an EAS marker, comprising:

a core having an x-axis, a y-axis, and a z-axis;

a first coil wrapped around the x-axis of said core in a first rotational direction and a second coil wrapped about the x-axis of said core in a second rotational direction counter to said first rotational direction;

a third coil wrapped around the z-axis of said core in a third rotational direction and a fourth coil wrapped around the z-axis of said core in a fourth rotational direction counter to said third rotational direction; and, at least one current source operatively connected to said first and said second coils, and said third and said fourth coils for supplying a current to excite each of said coils to produce a significant near magnetic field and a reduced far magnetic field.

2. The antenna of claim 1, wherein said core is a rectangular core.

3. The antenna of claim 1, wherein said core is formed of powdered iron.

4. The antenna of claim 1, wherein said first and said second coils comprises a first wire forming said first coil and said second coil, each of said first and said second coils being spirally wrapped about said core, and said third and said fourth coils comprises a second wire forming said third coil and said fourth coil, each of said third and said fourth coils being spirally wrapped about said core.

5. A method for simultaneously limiting a far magnetic field and enhancing a near magnetic field in an EAS marker antenna, comprising the steps of:

first spirally wrapping a first coil about an axis of a core in a first rotational direction;

second spirally wrapping a second coil about said axis of said core in a rotational direction counter to said first rotational direction;

combining said first and second coil to form a coil assembly;

third spirally wrapping a third coil about a second axis of said core in a third rotational direction;

fourth spirally wrapping a fourth coil about said second axis of said core in a rotational direction counter to said third rotational direction; and, adding said third and fourth coil to said coil assembly; and, supplying a current to said coil assembly to excite said coil assembly to produce a significant near magnetic field and a reduced far magnetic field.

6. The method according to claim 5, further comprising the step of placing an EAS marker in said near magnetic field of said EAS marker antenna during said supplying step, wherein said supplying step can activate or deactivate said EAS marker while producing a reduced far magnetic field.

7. A method for simultaneously limiting a far magnetic field and enhancing a near magnetic field in an EAS marker antenna, comprising the steps of:

spirally wrapping a first wire about an axis of a core in a first rotational direction;

reversing said first rotational direction and spirally wrapping said first wire about said axis of said core in a second rotational direction counter to said first rotational direction;

spirally wrapping a second wire about a second axis of said core in a third rotational direction;

reversing said second rotational direction and spirally wrapping said second wire about said second axis of said core in a fourth rotational direction counter to said third rotational direction; and, supplying a current to said first and said second wire to excite said first and said second wires to produce a significant near magnetic field and a reduced far magnetic field.

8. The method according to claim 7, further comprising the step of placing an EAS marker in said near magnetic field of said EAS marker antenna during said supplying step, wherein said supplying step can activate or deactivate said EAS marker while producing a reduced far magnetic field.

9. An electronic article surveillance (EAS) antenna for activating or deactivating an EAS marker, comprising:

a core having an x-axis, a y-axis, and a z-axis;

a first coil wrapped around the x-axis of said core in a first rotational direction and a second coil wrapped about the x-axis of said core in a second rotational direction counter to said first rotational direction; and, a third coil wrapped around the z-axis of said core in a third rotational direction and a fourth coil wrapped around the z-axis of said core in a fourth rotational direction counter to said third rotational direction.

10. A method for simultaneously limiting a far magnetic field and enhancing a near magnetic field in an EAS marker antenna, comprising the steps of:

first spirally wrapping a first coil about an axis of a core in a first rotational direction;

second spirally wrapping a second coil about said axis of said core in a rotational direction counter to said first rotational direction;

combining said first and second coil to form a coil assembly;

third spirally wrapping a third coil about a second axis of said core in a third rotational direction;

fourth spirally wrapping a fourth coil about said second axis of said core in a rotational direction counter to said third rotational direction; and, adding said third and fourth coil to said coil assembly.

* * * * *

UNITED STATES PATENT AND TRADEMARK OFFICE

CERTIFICATE OF CORRECTION

PATENT NO. : 6,396,455 B1
DATED : May 28, 2002
INVENTOR(S) : Ely et al.

It is certified that error appears in the above-identified patent and that said Letters Patent is hereby corrected as shown below:

Column 4,
Line 66, insert -- 12" x 3.5" x 1"; -- before “or”

Signed and Sealed this

Eighth Day of October, 2002

*Attest:*

*Attesting Officer*

JAMES E. ROGAN
*Director of the United States Patent and Trademark Office*